US012703557B2

(12) United States Patent
Brun et al.

(10) Patent No.: US 12,703,557 B2
(45) Date of Patent: Aug. 11, 2026

(54) PRODUCT WITH MULTIPURPOSE CONTAINED STRAINER

(71) Applicants: Marie Caroline Brun, Richmond, VA (US); Cody Kyeen White, Richmond, VA (US)

(72) Inventors: Marie Caroline Brun, Richmond, VA (US); Cody Kyeen White, Richmond, VA (US)

( * ) Notice: Subject to any disclaimer, the term of this patent is extended or adjusted under 35 U.S.C. 154(b) by 1069 days.

(21) Appl. No.: 16/969,240

(22) PCT Filed: Feb. 11, 2019

(86) PCT No.: PCT/US2019/017549
§ 371 (c)(1),
(2) Date: Aug. 12, 2020

(87) PCT Pub. No.: WO2019/157471
PCT Pub. Date: Aug. 15, 2019

(65) Prior Publication Data

US 2021/0002056 A1 Jan. 7, 2021

Related U.S. Application Data

(60) Provisional application No. 62/629,669, filed on Feb. 12, 2018.

(51) Int. Cl.
*B65D 81/26* (2006.01)
*B65D 17/28* (2006.01)

(52) U.S. Cl.
CPC ..... *B65D 81/261* (2013.01); *B65D 17/4011* (2018.01); *B65D 2517/0005* (2013.01); *B65D 2517/0056* (2013.01)

(58) Field of Classification Search
CPC ..... B65D 81/261; B65D 1/06; B65D 59/04; B65D 59/02; B65D 39/16; B65D 2517/5083; B65D 59/06; B65D 5/12
USPC ..... 220/23.9, 504, 528, 369, 370–372, 607, 220/625, 601, 269, 270
See application file for complete search history.

(56) References Cited

U.S. PATENT DOCUMENTS 1,673,703 A * 6/1928 Orman ..... A47L 19/04 220/628
5,782,373 A * 7/1998 Bianchi ..... B65D 17/4012 D9/518
6,467,982 B1 * 10/2002 Tsao ..... B65D 83/0055 401/263
8,662,338 B2 * 3/2014 Moricca ..... G21F 9/36 220/601
2009/0001079 A1 * 1/2009 Bitton ..... B65D 17/4011 220/200
2011/0226771 A1 * 9/2011 Manne ..... B65D 17/502 220/270
2011/0272417 A1 * 11/2011 Holstine ..... B65D 17/502 29/428
2017/0158386 A1 * 6/2017 Ruhmel ..... B65D 59/02
2018/0050925 A1 * 2/2018 Gregory ..... B65D 1/06
2020/0385159 A1 * 12/2020 Orchard ..... B65D 1/26

* cited by examiner

*Primary Examiner* — Robert Poon
(74) *Attorney, Agent, or Firm* — Robinson IP Law, PLLC

(57) ABSTRACT

A single use packing, dispensing, and rinsing technique, where a strainer element is a permanent part of the packaging, placed opposite of the primary opening, to allow a user to drain liquid contents from a container (packing fluid or user-introduced) while retaining the solid contents.

4 Claims, 2 Drawing Sheets

PRODUCT WITH MULTIPURPOSE CONTAINED STRAINER

CROSS-REFERENCE TO RELATED APPLICATION

This application claims priority to U.S. Provisional Patent Application Ser. No. 62/629,669 for a "Product with Multipurpose Contained Strainer" filed on Feb. 12, 2018, the contents of which are incorporated herein by reference in its entirety.

FIELD

The present disclosure relates to the field of consumer product packaging, and more specifically to food packaging for contents stored in liquids.

BACKGROUND

Many of the people who use canned food for cooking applications are faced with the problem of having to remove the food contents from the can in order to separate the liquid and solid contents of the can, or to rinse any remaining residue from the stored solid contents. U.S. Pat. No. 8,393,490 from Bitton illustrates a conventional package including pull tabs for opening a scored top container structure.

While this technology and other technology facilitate removal of liquid contents from a container, they fail to address the need to rinse the contents of a given container. What is needed, therefore, is a food packaging device that allows a user to easily drain contents of a container while also allowing for flow of a rinsing fluid through contents of the container without losing contents of the container.

SUMMARY

The invention concerns a food packaging device such as a can with two distinct openable ends. One opening has an opening tab for removing the top of the package, allowing for the removal of the entire contents of the packaging. The second end allows the removal of the bottom surface, which exposes a permanently fixed strainer element as a part of the packaging to allow the liquid contents to drain, while the primary contents are retained. This strainer element is fixed to the device and sealed by any means, for one example with an opening tab, in the same manner as the opening tab on the top of the package.

In a first aspect, a container includes: a container body having at least two open ends; a strainer located adjacent to and covering one of the two open ends of the container body, the strainer including a pull top defined by a scored edge for removal of the pull top to access contents of the container; a strainer end formed on the product container on an opposite end of the container, the strainer end including a plurality of openings formed therethrough; a sealing element located over the strainer for sealing the strainer; a first pull tab secured to the sealing element for removing the sealing element to allow access to contents of the container.

In one embodiment, a method of straining liquid from a container having food packed in liquid includes the steps: providing the container as described above, the containing food packed in liquid; pulling a first tab to remove the sealing element over the strainer on one end; and orienting the container to permit the liquid to exit the container through the strainer; adding water to the other openable end, in order to rinse the solid contents after draining the liquid.

The two opening ends of the product permit to use the product container as a strainer by itself.

In another embodiment, the method further includes pulling the second pull tab secured to the pull top for breaking the seal of the sealed container body on the opposite end of the strainer to permit access to the contents of the container.

In a second aspect, a container for food packed in liquid includes: a container body; a secured end with an opening pull tab; a strainer end secured to the container body for sealing an open end of the container body, the strainer end including a pull top defined by a scored edge to enable removal of the pull top, the pull top including a pull tab for removing the pull top and a strainer formed having a plurality of openings formed therethrough, the openings sized to permit passage of fluid while retaining food within the container body.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
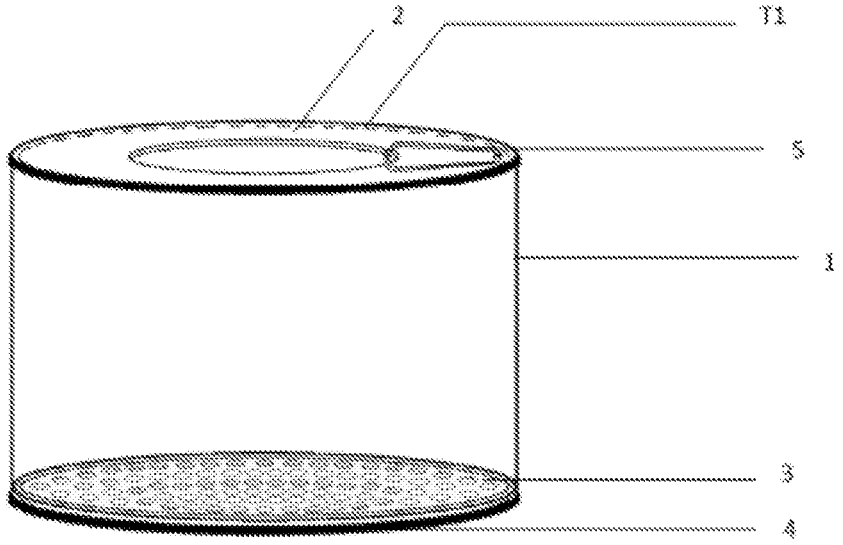
FIG. 1 shows a perspective of a product container including an open pull tab end and a strainer end according to one embodiment of the present disclosure.

A single use product container of FIG. 1 is formed with a container body 1, an opening pull tab end 2 having a pull tab 5 and weakened peripheral tear line T1, and a strainer end 3 included as a part of the can and sealed by another pull tab end 4. The container body 1, which is generally cylindrical (FIG. 1), has two open ends but may take other various suitable forms.

Figure 2:
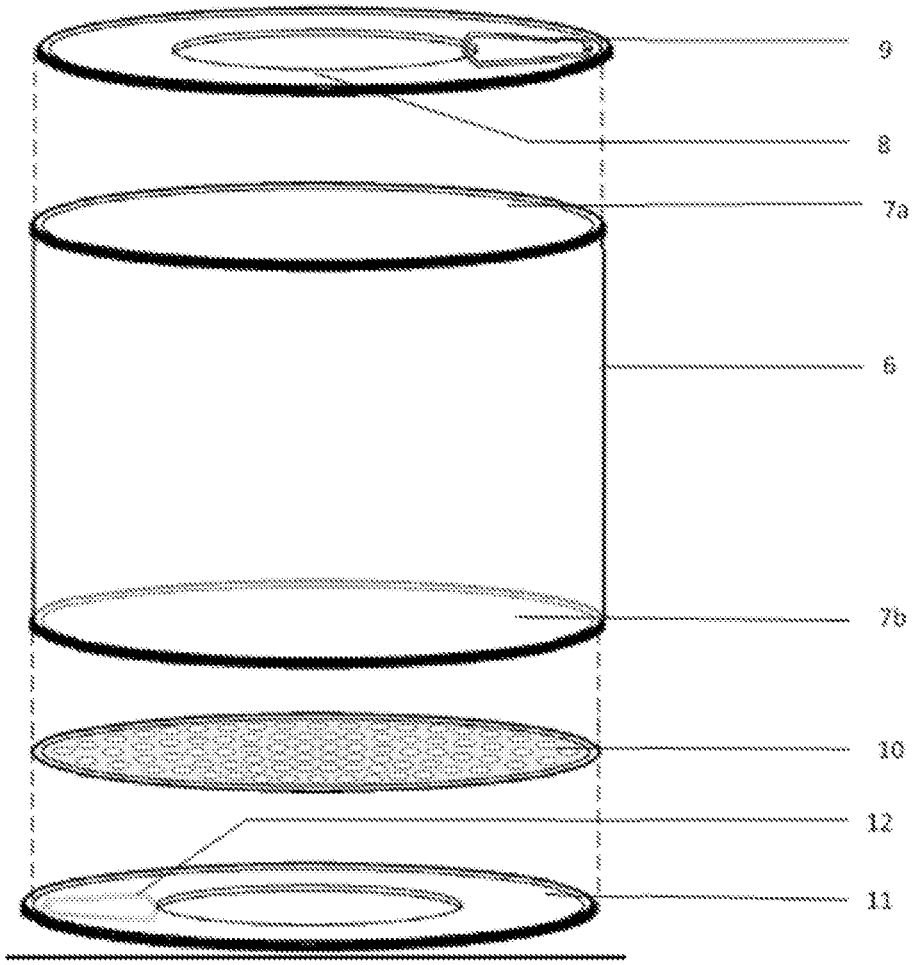
FIG. 2 is a perspective view a product container showing all the different parts separately according to one embodiment of the present disclosure.

As shown in FIG. 2, a product container 6 includes two openable ends 7*a* and 7*b*. At a top is a removable lid 8 with a pull ring or tab 9 that allows access to contents of the product container when opened. A strainer end on a bottom is composed of a strainer surface element 10 that is sealed permanently to the product container 6. The strainer element 10 is shaped and sized similarly to conventional product can container openings, which are generally roll-crimped to the product container 6, however it is formed by a metallic surface with holes allowing for the draining and rinsing of the contents of the can. Strainer element 10 may occupy the entire surface of one end. As such, it allows for fast and efficient draining of the liquid contained in the product container 6. With strainer element 10 placed on one end of the product container, the primary contents, such as vegetables, fruits, or other contents and packing liquid may be secured within the product container 6. The strainer openable end 7*b* includes a removable surface 11, which includes a pull ring or tab 12 to remove it by severing along a weakened periphery T2 of FIG. 3 to reveal the strainer element 10. Strainer end 7*b* can be sealed for distribution by any suitable mechanism, such as a lid with a pull tab for removal of the sealing element.

Strainer element 10 may be formed in various suitable shapes, e.g. round, rectangular or complex, as the design of the packaging container demands.

Figure 3:
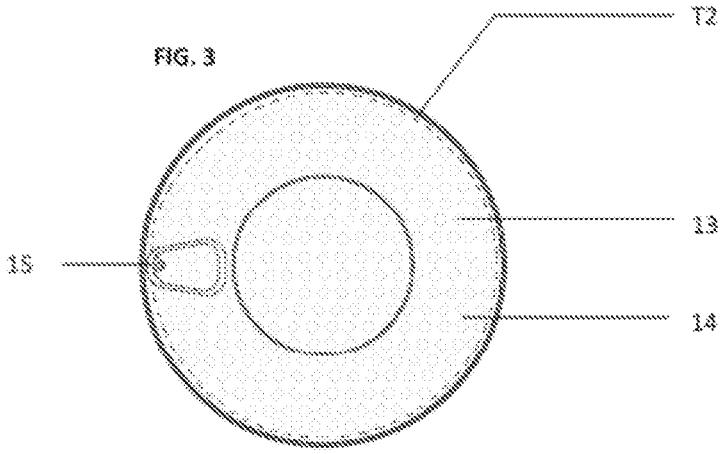
FIG. 3 is a top view of a strainer end and sealing element of a product container according to one embodiment of the present disclosure.

FIG. 3 is a perspective view looking upwards towards a bottom of the product container and representing the strainer end 7*b* of FIG. 2. The product container includes a strainer element 13, a lid 14 with a pull ring or tab 15 that permits the lid 14 to be removed revealing the strainer element 13.

Figure 4:
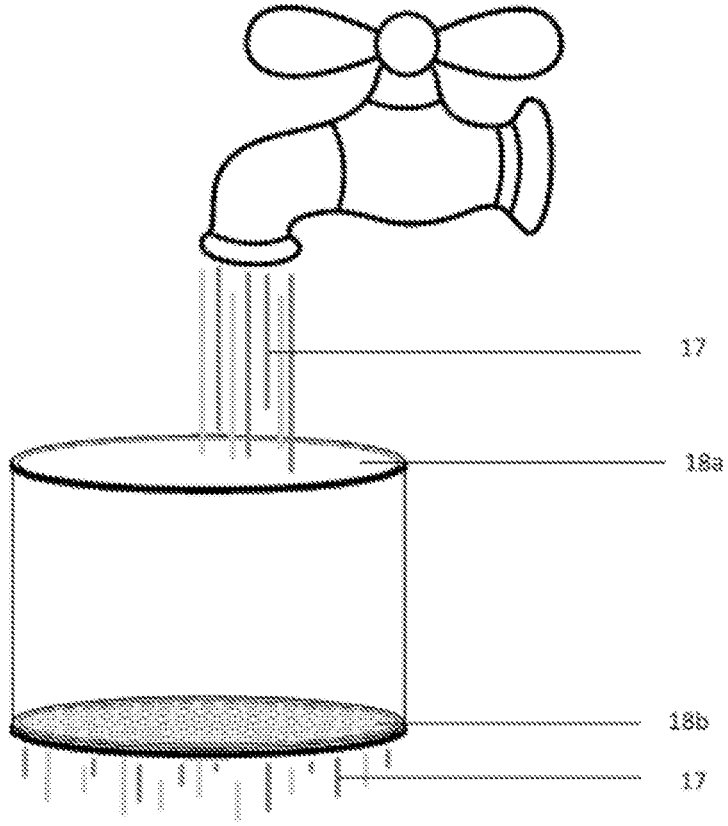
FIG. 4 is an example of usage of a product container as a rinsing device according to one embodiment of the present disclosure.

In operation, a user may grasp the tab 12 of FIG. 2 and pull to remove the sealing element and detach the removable surface 11. Product container 6 may then be oriented to allow the packaging liquid to empty through the strainer element 10 and out of the strainer end 7*b*. Upon completion of the draining of product container 6, a user may then grasp pull tab 9 and pull to detach the removable lid 8 from container body 6 permitting access to primary contents of the container. Then, as shown in FIG. 4, a user may add water 17 into an opening end 18*a*, allowing the water 17 to go through the opening end 18*a* and then out of a strainer end 18*b* to exit the product container and permit the primary contents (i.e., vegetables and fruits) to be rinsed off, without having to use another tool or utensil for the preparation of the product contents.

Strainer element 10 of FIG. 2 is sealed during the manufacturing process by sealing element 8 and 11. Pull tabs 9 and 12 are secured to sealing elements 8 and 11 and are used to unseal and remove the sealing elements 8 and 11.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A container comprising:

a container body having at least two open ends;

a strainer comprising a strainer element located adjacent to and covering one of the two open ends of the container body, the strainer element including a plurality of openings formed therethrough for allowing draining of contents of the container, wherein the strainer element occupies the entire surface of the one of the two open ends of the container body, the strainer being permanently sealed to and non-removably located on the one of the two open ends of the container body;

a removable surface with a first pull tab sealingly covering the plurality of openings of the strainer element, the removable surface being defined by a scored edge for removal of the removable surface;

a sealing element sealed on another of the two open ends and located over the other of the two open ends for sealing the other of the two open ends, wherein the sealing element is removably coupled to the other of the two open ends by a weakened periphery; and a second pull tab secured to the sealing element for removing the sealing element to allow access to the contents of the container.

2. A method of straining liquid from a container having food packaged in liquid, the method comprising the steps: providing the container as in claim 1, the containing food packed in liquid; pulling the first tab to remove the removable surface over the strainer on the one of the two open ends; and orienting the container body to permit the liquid to exit the container through the strainer element; adding water to the other of the two open ends, in order to rinse solid contents after draining the liquid, wherein the two open ends of the container body permit to use the container as a strainer by itself.

3. The method of claim 2, further comprising pulling the second pull tab secured to the sealing element for breaking the seal of the other of the two open ends of the container body to permit access to the solid contents of the container.

4. A container for food packed in liquid, the container comprising:

a container body;

a secured end with a first opening pull tab, wherein the secured end includes a weakened periphery for removing the secured end;

a strainer end secured to the container body for sealing an open end of the container body, wherein a strainer comprising a strainer element is permanently sealed to and non-removably located on the strainer end, the strainer element formed having a plurality of openings formed therethrough for allowing draining of contents of the container body, wherein the strainer element occupies the entire surface of the open end of the container body, the openings sized to permit passage of fluid while retaining food within the container body; and a removable surface sealingly covering the openings of the strainer element, the removable surface being defined by a scored edge to enable removal of the removable surface, the removable surface including a second pull tab for removing the removable surface.

* * * * *